US005901835A

United States Patent [19]

Hung

[11] Patent Number: 5,901,835

[45] Date of Patent: May 11, 1999

[54] ILLUMINATED ROTARY SWITCH

[76] Inventor: Wen-Hui Hung, 2F, No. 98, Lane 1, Sec. 2, Chung San Road, Pan Chiao City, Taipei Hsien, Taiwan

[21] Appl. No.: 09/014,601

[22] Filed: Jan. 28, 1998

[51] Int. Cl.[6] ..... H01H 9/00

[52] U.S. Cl. ..... 200/316

[58] Field of Search ..... 200/520–536, 200/571, 314, 315, 316, 308–313, 317, 11 R

[56] References Cited

U.S. PATENT DOCUMENTS

| | | | |
|---|---|---|---|
| 4,506,124 | 3/1985 | Rose et al. | 200/528 |
| 5,049,709 | 9/1991 | Prickett et al. | 200/527 |
| 5,252,794 | 10/1993 | Tseng | 200/51.15 |
| 5,586,645 | 12/1996 | Bartok | 200/527 |
| 5,743,387 | 4/1998 | Hung | 200/571 |

*Primary Examiner*—J. R. Scott
*Attorney, Agent, or Firm*—Browdy and Neimark

[57] ABSTRACT

An electrical switch capable of emitting light is composed of a base, a conductive disk, a switching conductive piece, a first, a second, a third and a fourth fastening conductive pieces, a light emitting diode, a cap, and a rotating mechanism. The conductive disk is disposed in a receiving cell of the base such that the conductive disk is fastened with the switching conductive piece. The light emitting element is connected at one end thereof with the first fastening conductive piece and at another end thereof with a pin which is in turn connected with one end of a power source. The power source is connected at another end thereof with the third and the fourth fastening conductive pieces. The rotating mechanism is composed of a rotary piece and a link column capable of actuating the rotary piece to drive the conductive disk so as to cause the switching conductive piece to connect the first fastening conductive piece with the third fastening conductive piece, or to connect the second fastening conductive piece with the fourth fastening conductive piece, thereby causing the light emitting element to unable to emit light when the electrical switch is turned on, and thereby causing the light emitting element to emit light when the electrical switch is turned off.

6 Claims, 3 Drawing Sheets

ILLUMINATED ROTARY SWITCH

FIELD OF THE INVENTION

The present invention relates generally to an electrical switch, and more particularly to an electrical switch capable of emitting light.

BACKGROUND OF THE INVENTION

The conventional electrical switch is incapable of emitting light and is therefore difficult to be found in a dark place where the electrical appliances or the lighting fixtures are located. It is conceivable that the conventional electrical switch can be rather inconvenient and hazardous.

SUMMARY OF THE INVENTION

The primary objective of the present invention is to provide an electrical switch capable of emitting light at such time when the electrical switch is in the "OFF" state.

In keeping with the principle of the present invention, the foregoing objective of the present invention is attained by the electrical switch consisting of a base, a conductive disk, a switching conductive piece, four fastening conductive pieces, a cap, a rotating mechanism, and a light emitting element. The conductive disk is located in a receiving cell of the base and is in contact with the switching conductive piece. The rotating mechanism is composed of a rotary piece and a displaceable actuator that can be either rotated, pushed or pulled. The rotary piece is fastened with the conductive disk such that the rotary piece can be triggered by the displaceable actuator to actuate the conductive disk. The light emitting element is connected at one end thereof with the first fastening conductive piece and at another end thereof with a pin which is in turn connected with one end of a power source. The power source is connected at another end thereof with the third and the fourth fastening conductive pieces. As the displaceable actuator is activated, the conductive disk is actuated by the rotary piece such that the first and the third fastening conductive pieces or the second and the fourth fastening conductive pieces are connected to bring about the switching effect. When the electrical switch remains in the "ON" state, the light-emitting element does not emit light. When the electrical switch remains in the "OFF" state, the light-emitting element emits light which is radiated into air through the cap pervious to light.

The foregoing objective, features, functions, and advantages of the present invention will be more readily understood upon a thoughtful deliberation of the following detailed description of two preferred embodiments of the present invention with reference to the accompanying drawings.

DETAILED DESCRIPTION OF THE INVENTION

Figure 1:
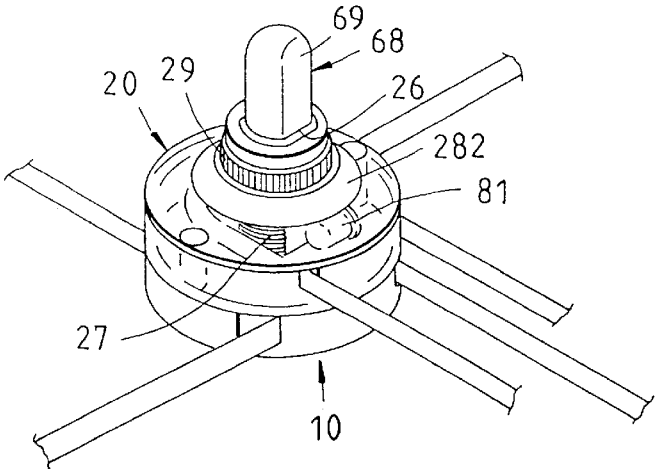
FIG. 1 shows a perspective view of a first preferred embodiment of the present invention.
Figure 2:
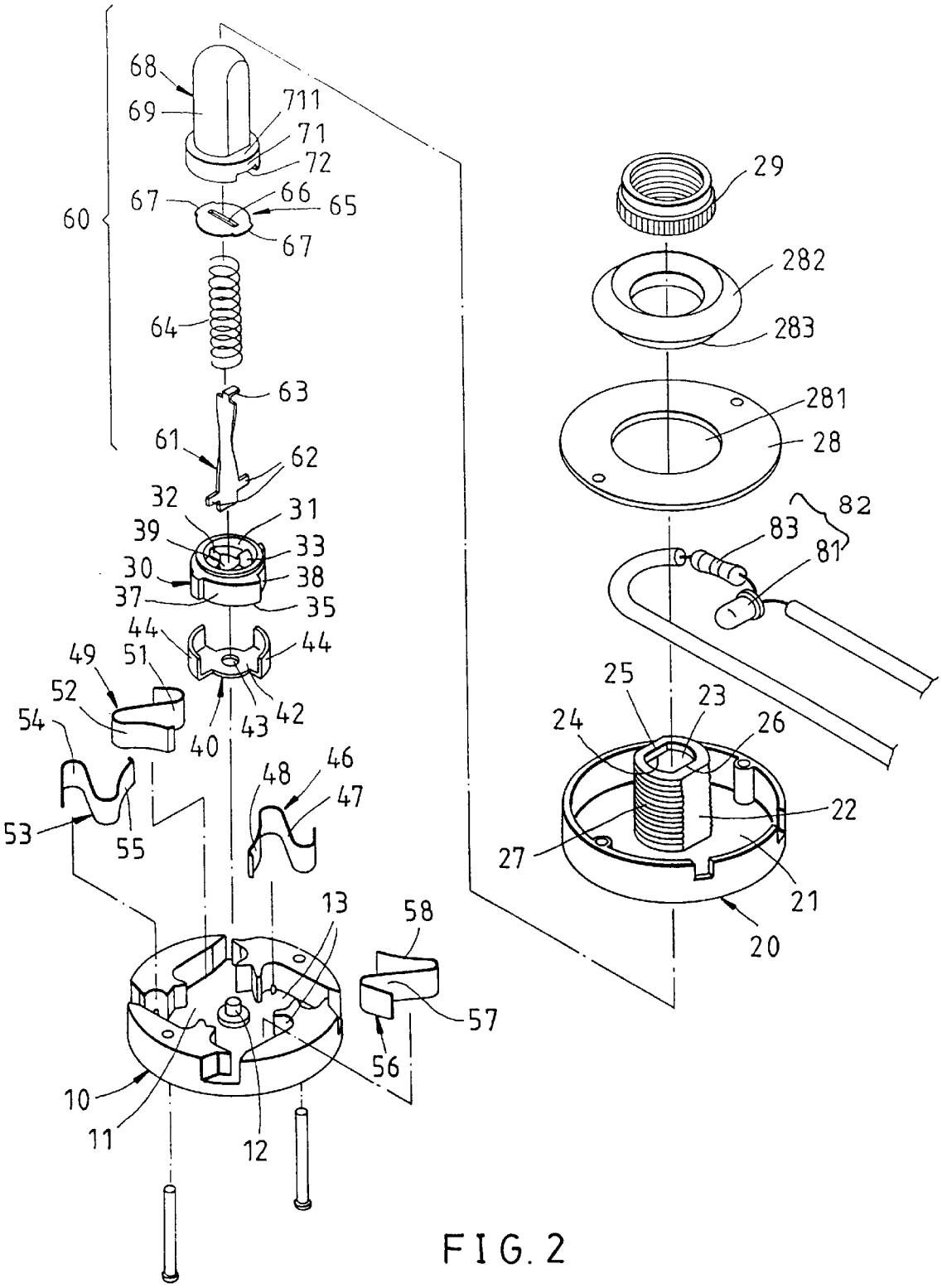
FIG. 2 shows an exploded view of the first preferred embodiment of the present invention.

As shown in FIGS. 1 and 2, an electrical switch of the first preferred embodiment of the present invention is composed of the component parts, which are described explicitly hereinafter.

A base 10 is provided with a receiving cell 11 which is in turn provided at the center thereof with a column 12, and four slots 13 arranged equidistantly around the column 12.

A container 20 of a disklike construction is pervious to light and is provided with a receiving compartment 21 which is provided at the center thereof with a hollow column 22. The hollow column 22 is provided in the top thereof with a through hole 23 which is in turn provided along the edge thereof with a circular shoulder 24 and two opposite tangent planes 25 and 26. The hollow column 22 is provided in the outer surface thereof with a threaded portion 27.

A cap 28 of a disklike construction is pervious to light and is provided with a through hole 281 which has a hole diameter slightly greater than the outer diameter of the hollow column 22 of the container 20. The cap 28 is joined with the container 20 such that the cap 28 covers the receiving compartment 21 of the container 20, and that the hollow column 22 is put through the through hole 281. The cap 28 is provided with a refractive ring 282 which has a connection ring 283. The refractive ring 282 is fastened with the cap 28 such that the connection ring 283 is lodged in the space located between the through hole 281 and the hollow column 22, and that the refractive ring 282 and the cap 28 are fastened securely with the container 20 by a nut 29, which is engaged with the threaded portion 27 of the hollow column 22.

A conductive disk 30 has an upper disk face 31, a lower disk face 35, and a side ring face 37. The upper disk face 31 is provided with four stepped portions 32 and a tapered face 33 located between the two stepped portions 32. The side ring face 37 is provided with two insertion slots 38. The conductive disk 30 is provided at the center thereof with a through hole 39.

A switching conductive piece 40 has a bottom 42, which is attached to the lower disk face 35 of the conductive disk 30. The bottom 42 is provided at the center thereof with a through hole 43 and two lugs 44 which are engaged with the insertion slots 38 of the conductive disk 30. The switching conductive piece 40 and the conductive disk 30 are joined together such that they can be rotated on the column 12 which is engaged with the through holes 39 and 43.

A first, a second, a third and a fourth fastening conductive pieces 46, 49, 53 and 56 are each provided respectively with an insertion portion 47, 51, 54, 57 and an arcuate portion 48, 52, 55, 58 extending from an engaging portion in the opposite directions. The first, the second, the third and the fourth fastening conductive pieces 46, 49, 53 and 56 are equidistantly arranged along the periphery of the conductive disk 30 such that the insertion portions 47, 51, 54 and 57 are retained in the four insertion slots 13 of the receiving cell 11, and that the arcuate portions 48, 52, 55 and 58 are attached to the side ring face 37 of the conductive disk 30.

A press-type rotating mechanism 60 consists of a rotary piece 61 of a spiral construction and having two wings 62 and a folded side 63. The wings 62 are connected with the stepped portions 32 of the conductive disk 30 and a coil spring 64 which is engaged at one end thereof with a strip hole 66 of an urging piece 65. The urging piece 65 is provided with two arresting lugs 67 opposite to each other.

A press column 68 has a hollow column 69, a protruded edge 71, two recesses 72 opposite to each other. The hollow column 69 juts out of the hollow column 22 of the container 20 via the through hole 23. The arresting lugs 67 of the urging piece 65 are retained in the recesses 72. The press column 68 is urged by the coil spring 64 such that the circular shoulder 711 of the protruded edge 71 is in contact with the circular shoulder 24 of the through hole 23.

Figure 3:
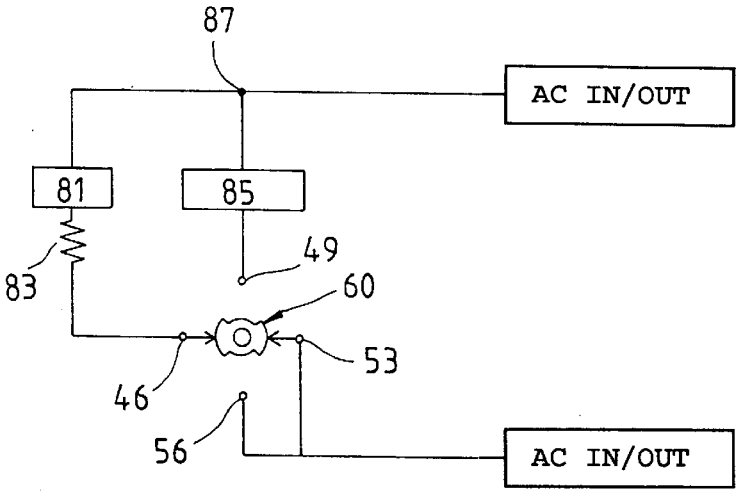
FIG. 3 shows a schematic view of the first preferred embodiment of the present invention in conjunction with a circuit of a lighting fixture.

As shown in FIG. 3, the electrical switch of the present invention is connected with a lighting fixture 85. The features of the present invention are described hereinafter.

The present invention further comprises a light emitting element 82, which is a light emitting diode 81 located in the receiving compartment 21 of the container 20 such that the light emitting diode 81 is connected at one end thereof with one end of a resistance 83 and at another end thereof with a pin 87. The resistance 83 is connected at another end thereof with the first fastening conductive piece 46. The lighting fixture 85 is connected at one end thereof with the pin 87 and at another end thereof with the second fastening conductive piece 49. The pin 87 is connected with an input end of a power source of alternating current. Another input end of the power source is connected with the third and the fourth fastening conductive pieces 53 and 56. The circuit positions of the light emitting diode 81 and the resistance 83 are interchangeable.

When the press column 68 is pressed, the urging piece 65 is actuated to move downward to force the rotary piece 61 to rotate, thereby causing the conductive disk 30 to turn an angle of 90 degrees. As a result, the lugs 44 of the switching conductive piece 40 are relocated to remain in the "OFF" or the "ON" state with each of the fastening conductive pieces 46, 49, 53, and 56. As shown in FIG. 3, the electrical switch of the present invention remains in the "OFF" state such that the lugs 44 of the switching conductive piece 40 are so located that the first fastening conductive piece 46 and the third fastening conductive piece 53 are connected. As a result, the alternating current returns to the alternating current loop via the light emitting diode 81 and resistance 83. In view of the alternating current which passes through the light emitting diode 81, the light emitting diode 81 is capable of emitting light, which is radiated through the container 20 and the cap 28 and is refracted by the refractive ring 292. The electrical switch of the present invention can be thus easily located in a dark place, thanks to the light emitted by the light emitting diode 81.

Figure 4:
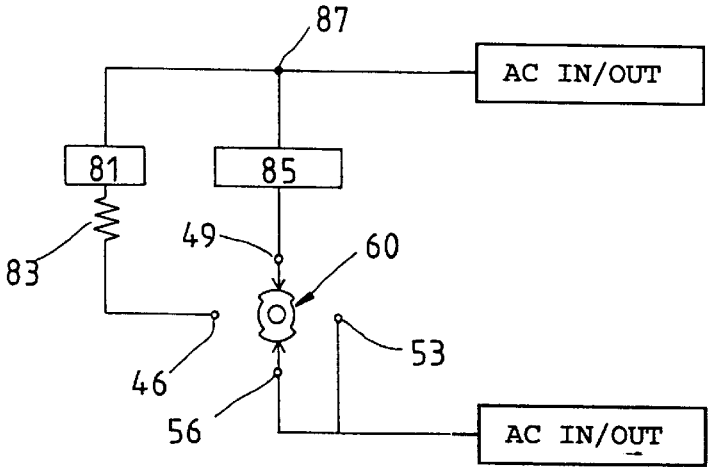
FIG. 4 shows another schematic view of the first preferred embodiment of the present invention in conjunction with the circuit of the lighting fixture.

As shown in FIG. 4, the electrical switch of the present invention is in the "ON" state such that the lugs 44 of the switching conductive piece 40 are so located that the second fastening conductive piece 49 and the fourth fastening conductive piece 56 are connected. As a result, the alternating current returns to the alternating current loop via the lighting fixture 85. The lighting fixture 85 is thus capable of emitting light, whereas the light emitting diode 81 is incapable of emitting light.

Figure 5:
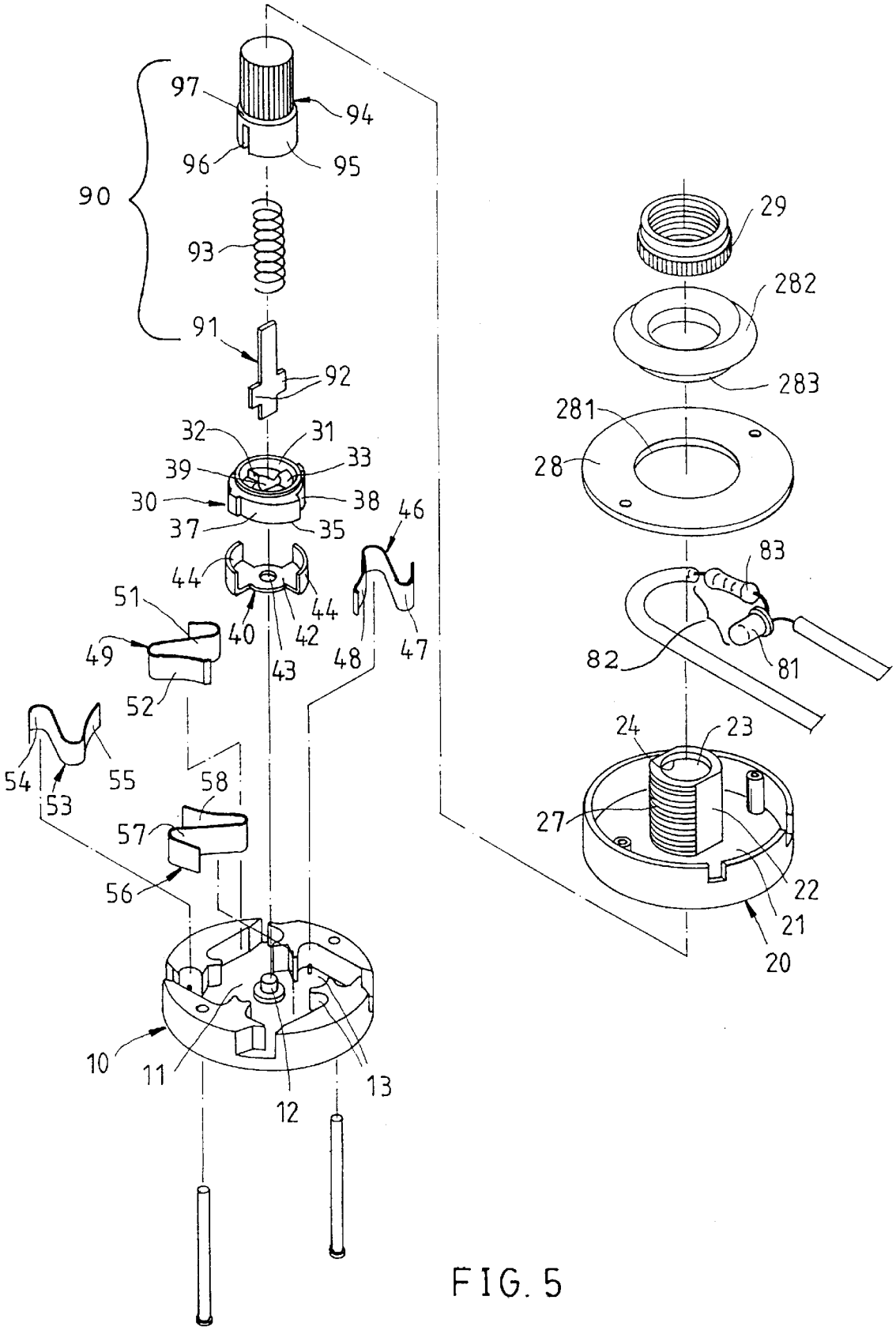
FIG. 5 shows an exploded view of a second preferred embodiment of the present invention.

As shown in FIG. 5, a second preferred embodiment of the present invention is different from the first preferred embodiment in that the second preferred embodiment has a rotation-type rotating mechanism 90 consisting of a rotary piece 91 having two wings 92 engageable with the stepped portions 32 of the conductive disk 30 such that the wings 92 are urged by one end of a coil spring 93 which is fitted over the rotary piece 91. Another end of the coil spring 93 urges a rotary column 94 which is provided along the edge of the bottom thereof with a protruded edge 95. The rotary column 94 juts out of the container 20 via the through hole 23 such that the wings 92 are retained in the two recesses 96 of the rotary column 94, and that a circular shoulder 97 of the protruded edge 95 urges the circular shoulder 24 of the through hole 23. As the rotary column 94 is turned clockwise, the rotary piece 91 is actuated to turn likewise to drive the conductive disk 30. As a result, the "OFF" and the "ON" states are formed among the fastening conductive pieces 46, 49, 53 and 56. If the rotary column 94 is turned counterclockwise inadvertently, the rotary piece 91 is actuated to turn likewise such that the wings 92 of the rotary piece 91 are caused to slide along the tapered face 33 of the conductive disk 30 to arrive at the stepped portions 32, and that the conductive disk 30 is not driven to rotate. A pull-type rotating mechanism is also applicable to the present invention.

What is claimed is:

1. An electrical switch capable of emitting light, said switch comprising:

a base having a first receiving cell provided with four insertion slots;

a conductive disk disposed in said first receiving cell and composed of an upper disk face, a lower disk face, and a side ring face, said upper disk face provided with a plurality of stepped portions arranged equidistantly such that a tapered face is located between two adjoining stepped portions, said side ring face provided with at least two insertion slots;

a switching conductive piece fastened at a bottom thereof with said lower disk face of said conductive disk and provided with two lugs extending from said bottom to engage said two insertion slots of said conductive disk;

a first, a second, a third and a fourth fastening conductive pieces provided respectively with an insertion portion, an arcuate portion extending from one end of said insertion portion in an opposite direction from said insertion portion, said four fastening conductive pieces being arranged along a periphery of said conductive disk such that said insertion portion of each of said four fastening conductive pieces is retained in one of said four insertion slots of said base;

a container having a second receiving cell joined with said base and provided with a hollow column extending uprightly from a center of said container, a cap on said container being pervious to light and fixed to said container by a nut threaded and said hollow column;

a light emitting element disposed in said second receiving cell of said container such that said light emitting element is connected at one end thereof with said first fastening conductive piece and at another end thereof with a pin which is in turn connected with one end of a power source, said power source being connected at another end thereof with said third fastening conductive piece and said fourth fastening conductive piece; and a rotating mechanism composed of a rotary piece and a displaceable actuator means for switching said light emitting element on or off located in said hollow column of said container, said rotary piece being connected with said upper disk face of said conductive disk such that said rotary piece is capable of being actuated by said displaceable actuator means to drive said conductive disk so as to cause said switching conductive piece to connect said first fastening conductive piece with said third fastening conductive piece, or to connect said second fastening conductive piece with said fourth fastening conductive piece, thereby causing said light emitting element to be off at such time when the electrical switch remains in an "ON" state, and thereby causing said light emitting element to be on at such time when the electrical switch remains in an "OFF" state.

2. The switch as defined in claim 1, wherein said light emitting element is disposed in said second receiving compartment; and wherein said cap is provided with a through hole which is engaged with said hollow column.

3. The switch as defined in claim 1, where said rotary piece has a spiral construction and is engaged with said upper disk face of said conductive disk; wherein said displaceable actuator means is engaged with an urging piece engaged to said rotary piece; and wherein said urging piece and said conductive disk engage therebetween a coil spring fitted over said rotary piece, wherein said displaceable actuator means is pushed to actuate the switch.

4. The switch as defined in claim 1, wherein said rotary piece is fastened to said displaceable actuator means and said upper disk face of said conductive disk, wherein said displaceable means is rotated to actuate the switch.

5. The switch as defined in claim 1, wherein said displaceable actuator means said cap are provided therebetween with a refractive ring for refracting light emitted by said light emitting element.

6. The switch as defined in claim 1, wherein said light emitting element is composed of a light emitting diode and a resistance.

* * * * *